United States Patent [19]

Coons, III et al.

[11] Patent Number: 4,993,130

[45] Date of Patent: Feb. 19, 1991

[54] CONTINUOUS HIGH SPEED METHOD FOR MAKING A COMMINGLED CARPET YARN

[75] Inventors: Andrew M. Coons, III, Anderson; James P. Sullivan, Seneca, both of S.C.

[73] Assignee: BASF Corporation, Williamsburg, Va.

[21] Appl. No.: 345,876

[22] Filed: May 1, 1980

Related U.S. Application Data

[60] Division of Ser. No. 243,170, Sep. 8, 1988, which is a continuation of Ser. No. 895,648, Aug. 12, 1986, abandoned.

[51] Int. Cl.[5] ..... D02G 1/16; D02J 1/08

[52] U.S. Cl. ..... 28/271; 28/274

[58] Field of Search ..... 28/220, 221, 254, 258, 28/271, 272, 274, 281

[56] References Cited

U.S. PATENT DOCUMENTS

| | | | |
|---|---|---|---|
| Re. 28,254 | 11/1974 | Buzano | 28/271 X |
| 3,898,719 | 8/1975 | Lloyd | 28/274 |
| 4,011,640 | 3/1977 | Keith | 28/274 |
| 4,025,595 | 5/1977 | Mirhej | 28/271 X |
| 4,035,883 | 7/1977 | Bond | 28/220 |
| 4,295,329 | 10/1981 | Windley | 28/220 X |
| 4,299,015 | 11/1981 | Marcus et al. | 28/221 |
| 4,505,013 | 3/1985 | Nelson | 28/274 |
| 4,535,516 | 8/1985 | Egbers et al. | 28/274 X |

*Primary Examiner*—Werner H. Schroeder
*Assistant Examiner*—David K. Suto
*Attorney, Agent, or Firm*—Tom R. Vestal

[57] ABSTRACT

A continuous, high speed (greater than 800 meters per minute) process and apparatus enable the production of a multifilament carpet yarn having a degree of filament intermixture high enough so that a standard deviation of less than 6.0 results upon conducting a Standard Yarn Streak Potential Test, as described herein. The apparatus and process allow the production of a multicolored carpet yarn which exhibits a reduced tendency to streak and an increased retention of tip definition.

2 Claims, 6 Drawing Sheets

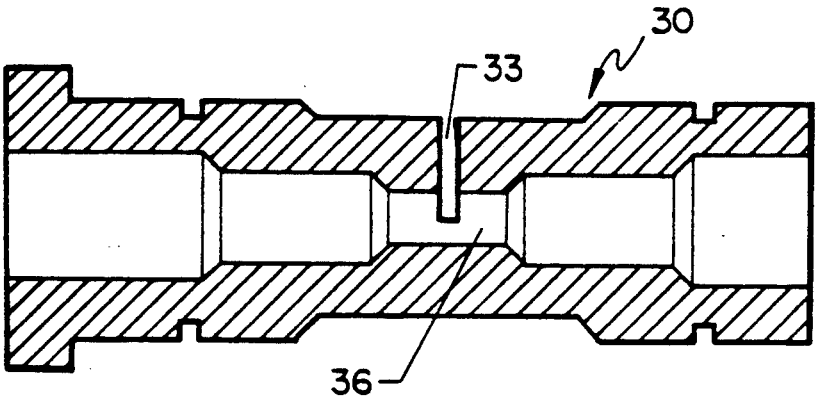
FIGURE 4A
FIGURE 4B
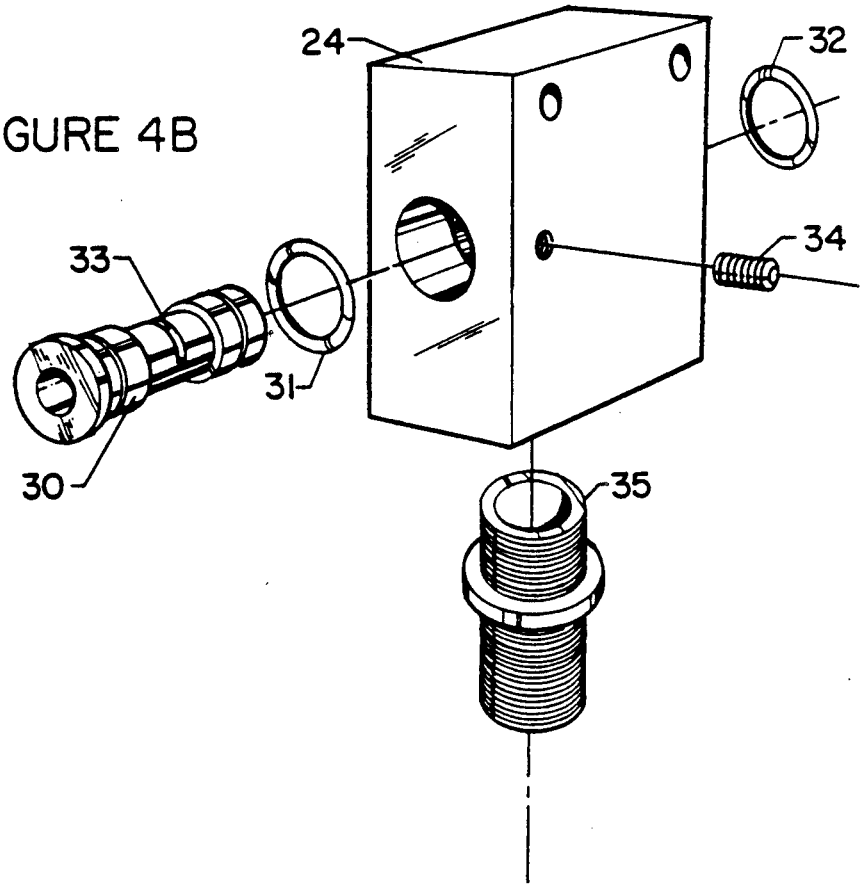

CONTINUOUS HIGH SPEED METHOD FOR MAKING A COMMINGLED CARPET YARN

This is a divisional of co-pending application Ser. No. 07/243,170, filed on Sept. 8, 1988, which is a continuation of application Ser. No. 06/895,648, filed Aug. 12, 1986, now abandoned.

BACKGROUND OF THE INVENTION

1. Field of the Invention

The present invention pertains to the fields of textile manufacturing, processes for shaping or treating plastic articles, textile spinning, twisting, and twining and textiles, fluid treating apparatus.

With respect to the field of textile manufacturing, the present invention is related to the areas of (a) thread finishing by diverse finishing operations; (b) thread finishing by texturing (e.g. crimping) in which there is a control means responsive to a sensed condition; (c) thread finishing utilizing diverse texturing operations; (d) thread finishing via fluid jet having orthogonally arranged flow paths; (e) thread finishing via fluid jet having opposed reasonance chambers; (f) thread finishing via fluid jet having opposed fluid passageways.

With respect to processes for shaping or treating plastic articles, the present invention is related to the areas of: (g) processes involving twining, plying or braiding or textile fabric formation; (h) processes involving the formation of continuous or indefinite length work; (i) shaping filaments by extrusions.

With respect to textile spinning, twisting and twining, the present invention is related to the areas of (j) the strand structure of multifilament yarns wherein the filaments are crimped or bulked; (k) jet interlacing or intermingling of filaments.

With respect to the field of textiles, fluid treating apparatus, the present invention is related to the area of gas, steam, or mist treatment with continuous textile feed and discharge.

2. Description of the Prior Art

Many prior art patents are related to the process of the present invention. The closest patent is believed to be U.S. Pat. No. 4,505,013. Other patents of interest include the following U.S. Pat. Nos.: 4,355,592; 4,222,223; 3,010,270; 4,343,146; 3,953,962; 3,898,719; 3,874,045; 3,874,044; 3,811,263; 3,251,181. None of these prior art patents are believed to enable the process of the present invention. The present invention enables the continuous, high speed production of a highly and uniformly entangled multifilament carpet yarn. The prior art does not provide any means for achieving a degree and uniformity of entanglement at the process speeds of the present invention.

BRIEF SUMMARY OF THE INVENTION

The present invention is directed towards a continuous, integrated, high speed process for making a multifilament carpet yarn having a very high degree of filament intermixture. The process comprises the steps of:

(a) forwarding an undrawn multifilament carpet yarn;

(b) drawing the yarn until the elongation of the filaments has been reduced to an acceptable level for end use in carpeting applications, the drawn yarn having a denier between 2000 and 4000, the drawn filaments each having a denier between 18 and 35;

(c) crimping the drawn filaments with a jet crimping means;

(d) over-feeding the yarn to an intermixing jet, the degree of over-feeding being between 1% and 10%;

(e) intermixing the drawn, textured yarn in the intermixing jet, the intermixing jet creating a degree of entanglement of the filaments whereby a standard deviation of less than 6.0 results upon conducting a Standard Yarn Streak Potential Test; and (f) taking up the textured, interlaced yarn at a speed of at least 800 meters per minute.

The present invention is most particularly concerned with intermixing the filaments to a very high degree. "Intermixing", as used herein is to be contrasted with entangling, interlacing and texturing. Interlacing is used to slightly entangle filaments together, so that the interlaced multifilament yarn will undergo subsequent processing with reduced flaring and individual filament wrapping. Texturing is a term used to describe mechanical deformation of filaments in order to form a textured (i.e. "crimped") filament. Both texturing and interlacing can be performed in conjunction with high speed yarn processing by using fluid jets. However, neither texturing nor interlacing creates a high degree of filament entanglement. Entangling, on the other hand, is generally utilized to create a degree of filament entanglement which is equivalent in degree to the amount of filament entanglement created by the "intermixing" process of the present invention. However, entanglement processes of the prior art have been notoriously slow, because it has never (heretofore) been possible to achieve an exceedingly high degree of filament entanglement at yarn take-up speeds in excess of about 800 meters per minute. Thus, the term "intermixing", as used herein, is defined to include only processes which enable (1) a degree of entanglement which yields a standard deviation of less than 6.0 when measured by a Standard Yarn Streak Potential Test described below while (2) the take-up speed is greater than 800 meters per minute. It has been surprisingly found that such a process is possible, and to-date the only known way of carrying out such a process is to use both supersonic steam impact on the traveling yarn along with a particular fluid jet design which will efficiently and continuously entangle the filaments to a degree which renders a standard deviation of less than 6.0 upon conducting a Standard Yarn Streak Potential Test. The process provides an additional advantage of enabling a high speed method for producing a carpet yarn which has very good tip definition in comparison with prior art carpet yarns which were made at take-up speeds below 800 meters per minute It is an object of the present invention to provide a high speed, one-step process for intermixing the filaments of a bulked continuous filament carpet yarn.

It is a further object of the present invention to enable the high speed production of a multicolored carpet yarn having a low streak potential as measured by the Standard Yarn Streak Potential Test as defined herein.

It is a further object of the present invention to improve the degree of filament entanglement for processes having take-up speeds above 800 meters per minute.

It is a further object of the present invention to enable, at speeds greater than 800 meters per minute, the production of a bulked continuous filament yarn having a woolish look and texture.

It is a further object of the present invention to eliminate the need for commercial processes to have a plying step necessary in the production of low-streak bulked continuous filament carpet yarns.

It is a further object of the present invention to produce a bulked continuous filament carpet yarn having filaments which are entangled along their entire length rather than at nodal points.

It is a further object of the present invention to combine a plurality of yarns having different coloration potentials, while creating a product which is made both at high speed and with a low streak potential.

It is a further object of the present invention to utilize steam at supersonic speeds in order to achieve intermixing of the filaments.

BRIEF DESCRIPTION OF THE DRAWINGS

FIG. 4A is a longitudinal cross-sectional view of a high speed jet entangling insert of the present invention.

FIG. 4B is an exploded perspective view of the jet intermixing insert and its housing and fluid supply

FIG. 6A illustrates an untrafficked, carpet made without the advantages of the present invention, while

FIG. 7A illustrates an untrafficked carpet made with the advantages of the present invention, while

DETAILED DESCRIPTION OF THE PREFERRED EMBODIMENTS

Figure 1:
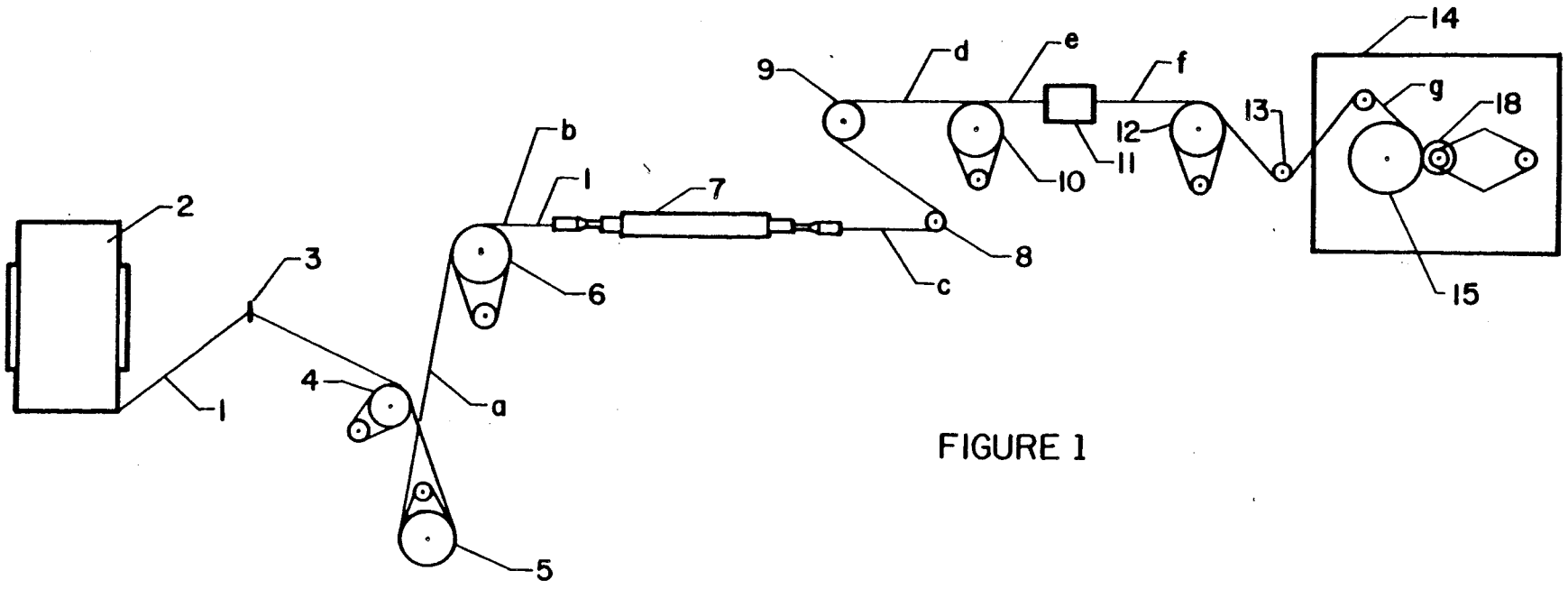
FIG. 1 is a schematic of a process of the present invention.

FIG. 1 illustrates, in schematic form, the process of the present invention. An undrawn feed yarn (1) is taken off of a package (2), fed through a first guide (3) and makes about 3 wraps around a first godet (4). The first godet (4) is used to pretension the yarn. The yarn is then drawn between a second godet (5) and a third godet (6). The yarn makes 7 or 8 wraps around both the second godet (5) and the third godet (6). The yarn (1), now drawn, is then texturized in a texturizing tube (7). This texturizing tube is described in U.S. Pat. Nos. 3,908,248 and 3,714,686, which are hereby incorporated by reference. The now texturized yarn (1) then travels over a direction changing roll (8) and a tensioning device (9) after which the yarn contacts a fourth godet (10) and a fifth godet (12). The texturized yarn is overfed from the fourth godet (10) to the fifth godet (12). Between these godets (10 and 12) is an intermixing jet (11). After exiting the fifth godet the yarn (1) passes over another direction changing roller (13) and onto the traverse roll (16) of a winder (14). A yarn package (18) is then built up upon a package tube not shown, the package (18) being driven by a friction roll (15). A second package tube is to be rotated into contact with the friction roll (15) after a full package (18) is built up upon tube.

Figure 3:
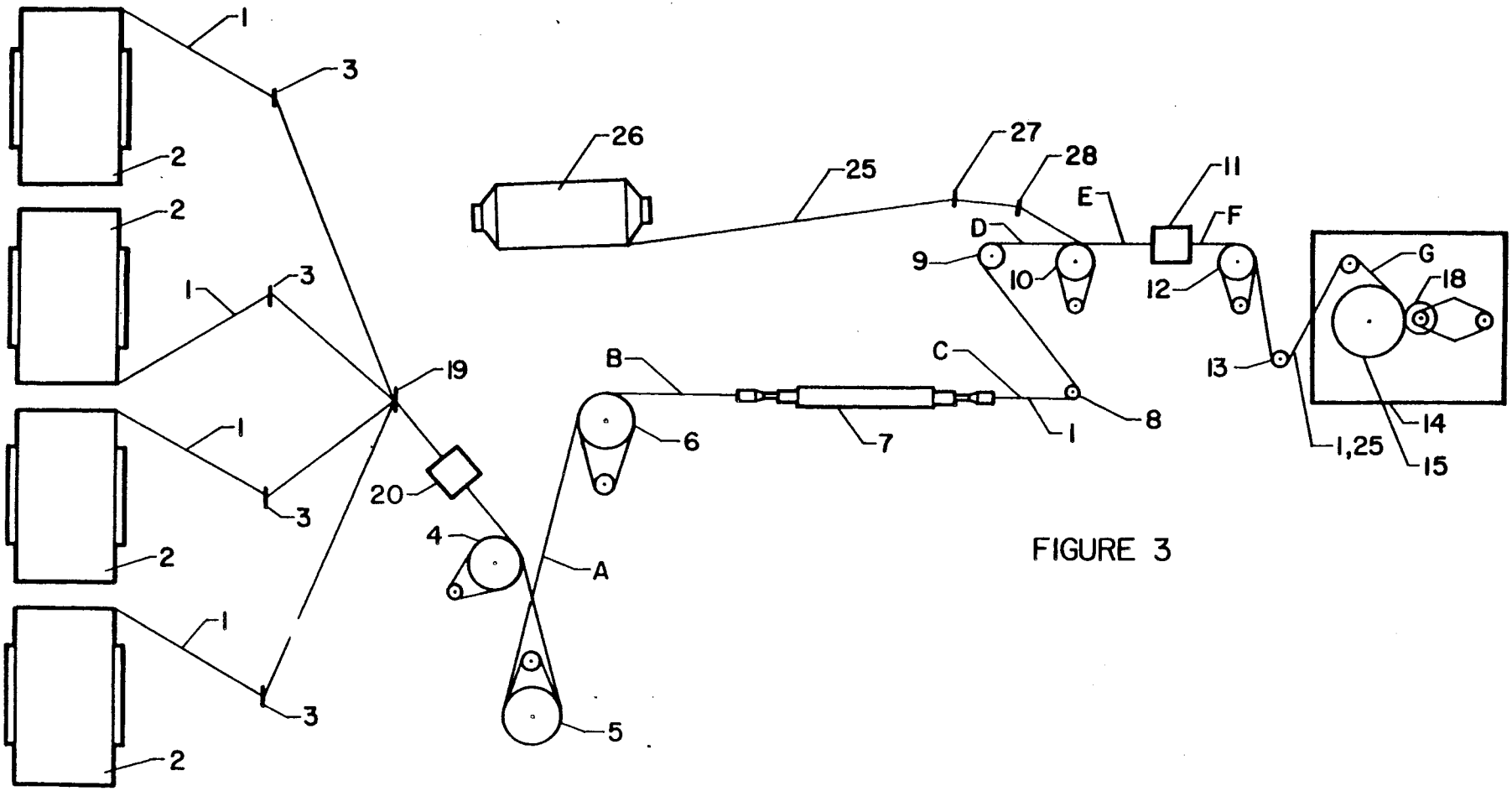
FIG. 3 is a schematic of yet another alternative process of the present invention.

FIG. 3 illustrates a schematic of a preferred process of the present invention. In this process, eight (only four packages (2) are shown) primary, feed-yarns (1), held on packages (2), are each threaded through individual guides 3. All eight of these primary feed-yarns (1) are then passed through a second guide (19) and a preinterlacer (20), and are then fed to the pretensioning godet (4). The primary yarns (1) are then drawn between the second godet (5) and the third godet (6), and the drawn yarns (1) are then texturized in the texturizing tube. After passing over direction changing rolls 8 and 9, the yarn (1) pass around the fourth godet (10). An additional yarn (25) herein termed an "accent yarn" is merged into the drawn, texturized yarns (1) on the fourth godet (10). The accent yarn is preferably also solution dyed (i.e. pigmented). The accent yarn (25) is supplied from a package (26), the accent yarn passing through two guides (27 and 28) before going onto the fourth godet (10). Upon exiting the fourth godet (10), the yarns (1 and 25) are intermixed in the entangling jet (11). The yarns are over-fed to the intermixing jet (11) by having the surface speed of the fourth godet (10) higher than the surface speed of the fifth godet (12). The yarns (1 and 25) then pass over a direction changing guides (13) and onto winder 14, and are wound to form package 18, as described above.

Figure 4C:
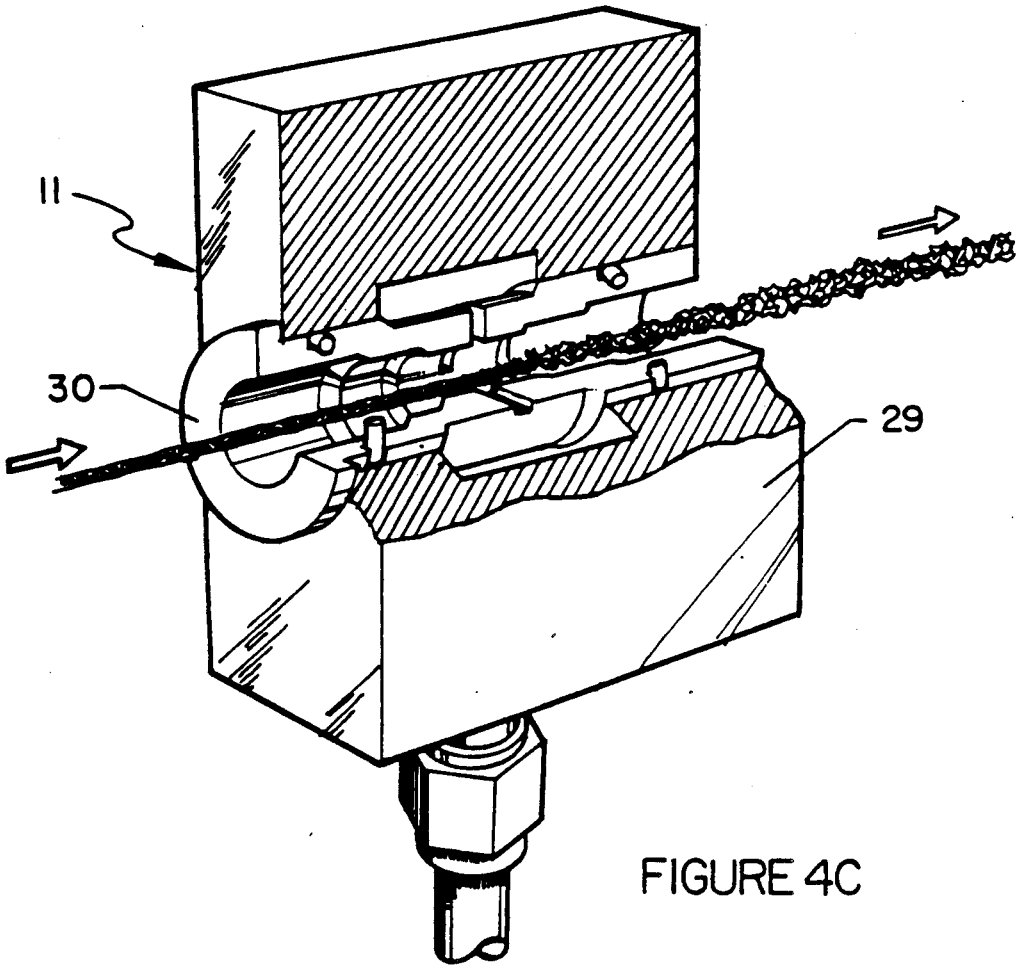
FIG. 4C is a perspective cut-away view of the insert installed in the housing, together with a simulation of a yarn traveling through the intermixing insert.

FIGS. 4A, 4B, and 4C show detailed view of the intermixing jet (11) which is utilized to intermix the filaments in the process of the present invention. The intermixing jet (11) is comprised of an insert housing (29) having an insert (30) which is positioned therein. The flow of steam is partially confined by O-rings 31 and 32, these O-rings forcing the steam to travel through a slit (33) in the insert (30), i.e., the O-rings 31 and 32 preventing the steam from escaping between the housing (29) and the insert (30). The insert (30) is locked into place with a setscrew (34), and steam is supplied to the housing via an opening (not shown) to which is attached a threaded connector (35). The slit (33) in the insert (30) is approximately 1.4 millimeters wide, and preferably extends approximately 180 degrees around the circumference of the insert. As a result of the shape of the slit (33), the yarn traveling through the intermixing jet (11) cannot escape continuous impingement of supersonic steam which is entering the yarn-impact chamber 36 via slit 33. The shape of the slit (33) creates an inescapable flow of steam. It is believed that this inescapable flow is largely responsible for the "continuous intermixing" (to be distinguished from "nodal entanglement") produced by the present invention. Nodal entanglement creates spaced regions of high filament entanglement between which are regions virtually free of filament entanglement. The "continuous intermixing" form of entanglement produced by the process of the present invention contrasts with nodal entanglement in that the filaments are entangled along the entire length of the yarn, there being no regions without a fairly high degree of filament entanglement.

The process of the present invention is "continuous" in time. That is, the process carries out drawing, texturizing, and intermixing all at once. In contrast, commercial prior art processes have utilized a separate and expensive plying step in order to create a carpet yarn which had a low streak potential, as measured by the test described below.

The process of the present invention is "intergrated" in that the steps of drawing, texturizing, and intermixing are carried out in a single operation rather than as separate operations which require separate yarn winding steps. Prior art commercial processes which utilizing plying to create a low streak-potential product also require an additional winding step, which increases manual handling, energy consumption, and costs.

The process of the present invention is "high speed" in that the yarn must be taken up at a speed of at least 800 meters per minute. Prior art processes which have produced a jet-entangled yarn having a streak-potential as low as that of the present invention have operated at significantly lower speeds—i.e., below 800 meters per minute and generally between 100 and 500 meters per minute. This is because the prior art has not had the means to create a high degree of continuous filament intermixing at a high speed.

"Crimping" has been defined above as mechanical deformation of filaments in order to form a texturized filament Although the crimping may be carried out in a variety of manners, it is most preferable that the process utilize the crimping tubes taught in U.S. Pat. Nos. 3,908,248 or 3,714,686.

The process illustrated in FIG. 1 can be carried out with an uncolored, dyeable feed yarn, with a dyed feed yarn, or with a precolored (pigmented) feed yarn. The high degree of intermixing (for a yarn of only a single color) provides the advantage of producing, at high speed, a yarn which will show delayed "ugly-out" when made into a cut pile carpet. "Ugly-out" is a term used to describe the loss of tip definition caused by heavy traffic on the carpet. Heavy traffic causes the filaments of each yarn to flair out, causing a "mushy" and "indistinct" look which is undesirable. It has been found that the intermixed yarn, when made by the process described herein, tolerated more traffic while exhibiting less ugly-out than carpets made from carpet yarns which had been entangled to a lesser degree.

Figure 2:
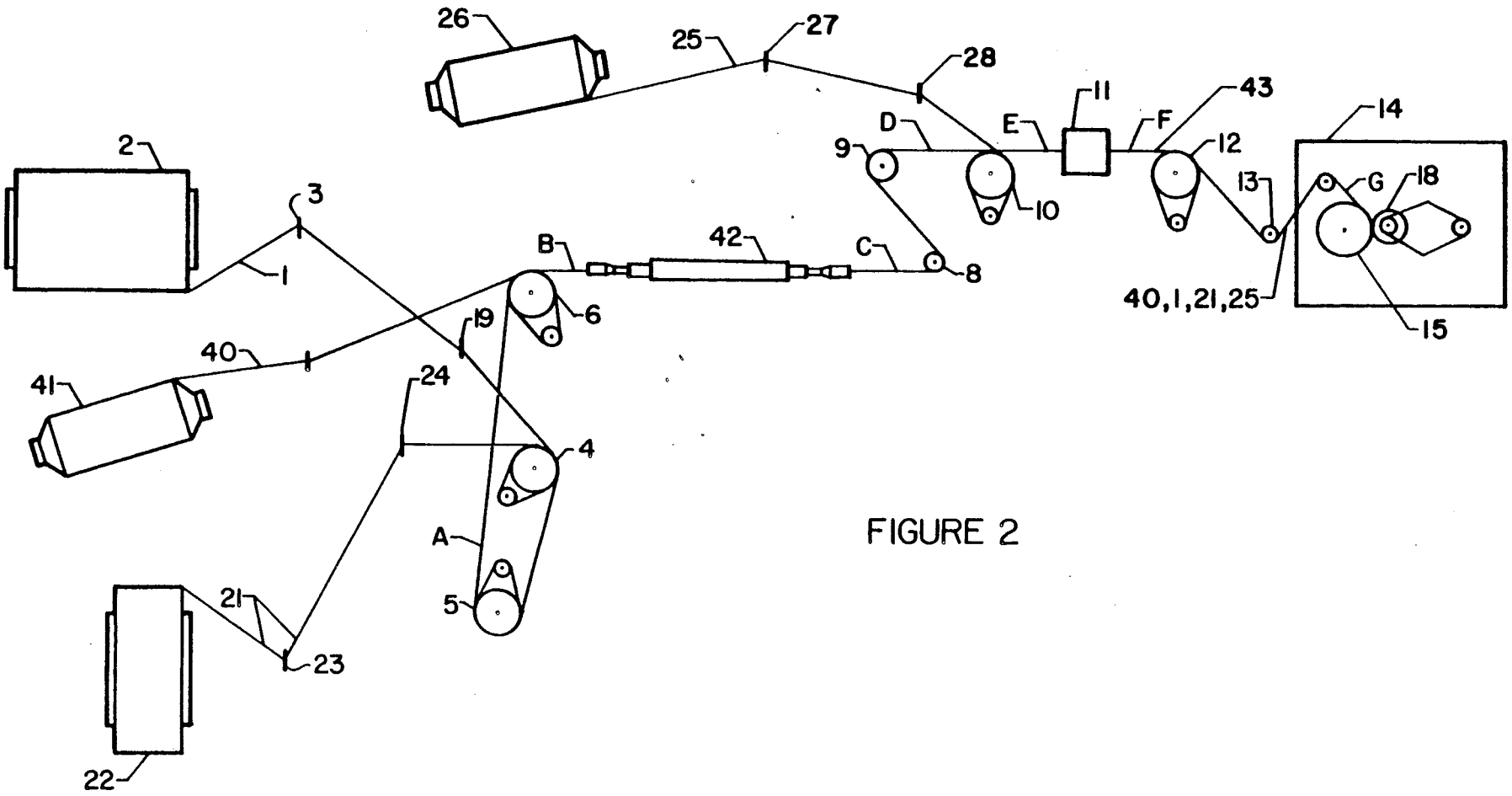
FIG. 2 is a schematic of an alternative process of the present invention.

The process of the present invention is advantageously carried out as shown in FIG. 2. The greatest assets of the present invention lie in its advantages for combining yarns which have significantly different coloration potentials. The high degree of entanglement of textured yarns produces a yarn which not only exhibits delayed ugly-out, but also has fewer streaks than prior art carpet yarns produced at similar speeds without a plying step. Streaking is always a problem with bulk continuous filament carpet yarn comprising filaments of substantially different coloration, and it has long been the practice to ply two yarns together in order to reduce the potential for streaking to result. The plying operation is an additional step and is time consuming and expensive. The process shown in FIG. 2 may utilize, for example, one white (undyed) polyamide primary feed yarn (1) which is acid dyeable, one black (pigmented) polyamide tonal primary feed yarn (21) and a fully drawn, untextured, red (pigmented) accent yarn (25). The combined yarns, once wound onto the package (18), will appear as a grey yarn (tonal yarn mixed evenly with the white feed yarns) along with a red accent yarn which stays bundled together (i.e. is not intermixed). In a carpet made from this yarn, if the white yarn was left undyed the carpet would appear to have a grey base and a red "berber" effect. The grey is created by the high degree of mixing of black and white filaments and the red "berber" effect is created by the lack of mixing of the red filaments with either the black or white filaments. The entangling jet (11) has been found to effectively intermix only the crimped filaments. The untextured filaments of the accent yarn (25) are not intermixed by the entangling device (11). Rather, these filaments remain relatively intact as a bundle. It has been theorized that it is the excessive length (i.e., potential slack) present in crimped yarns together with the fullness (i.e., low density) present in crimped yarns which allows the impact of a fluid stream to create a greater degree of filament entanglement than with uncrimped yarns.

The present invention is most useful in the manufacture of bulked continuous filament carpet yarns which, when drawn, have a denier between 2000 and 4000, the drawn filaments each having a denier between 18 and 35.

The present invention pertains to a process which intermixes drawn, textured filaments in the intermixing jet, the intermixing jet creating a degree of intermixing of the filaments whereby a standard deviation of less than 6.0 results upon conducting a Standard Yarn Streak Potential Test. The Standard Yarn Streak Potential Test is conducted as follows:

Two primary feed yarns are drawn, textured, intermixed, and wound onto a package. One of the feed-yarns is a 9100 denier (before drawing), 135 filament semi-dull bulked continuous filament white yarn. The other feed yarn is a 2625 denier (before drawing) 42 filament black bulked continuous filament feed-yarn. The resulting drawn (by a factor of 3.2×), textured, intermixed, wound product is used to make a 0.1 guage, level loop, 28 ounce/square yard carpet having a pile height of 3/16 inches. The carpet is tested by making colorimetric measurements with the Small Angle View attachment on a Macbeth 1500 colorimeter at between 65 and 100 different locations on the carpet. The Macbeth 1500 colorimeter analyzed an area of approximately 2 cm×1 cm, this area being oriented in the direction of tufting (i.e., along the length of the yarn). The values obtained were averaged to establish a standard reference point. Then another 35 to 50 additional measurements were made and compared against the standard reference point. The DL's were recorded, from which a standard deviation was calculated. The standard deviation is a quantitative measurement of the degree of color mixing obtained in the sample. It should be emphasized that the Standard Yarn Streak Potential Test requires that: (1) the yarns used are: (a) a drawn and textured 2600 denier/135 filament semi-dull white yarn, and (b) a 750 denier/42 filament black yarn; and (c) that the standard reference point and the 35 to 50 additional measurements are made on the same type of carpet as described above and that the measurements are taken in the same manner as described above.

The Standard Yarn Streak Potential Test can be carried out in order to determine whether any process which draws, texturizes, and intermixes via fluid jet will create a product having a standard deviation of less than 6.0. One must simply substitute the feed-yarns (described above) into the process, make the carpet according to the description above, and analyze the carpet as described above. It is most preferred that the degree of intermixing is high enough so that the resulting standard deviation is less than 5.0.

It has been determined that the intermixing jet utilized in the present invention should have a yarn-impact chamber (36, as shown in FIG. 4A) diameter between 3/64 inches in diameter and 3/16 inches in diameter It has also been found that the length to diameter ratio within the yarn-impact chamber (36) is most preferably 2.4. It has been found that an L/D of 2.0 does not result in sufficient intermixing and that an L/D of 2.8 results in a product having too much "stiffness" (i.e., a harsh hand). The slot (33) is most preferably about 0.044 inches wide and most preferably extends 180 degrees around the yarn-impact chamber, creating an "inescapable" jet of fluid to impact the yarn in the yarn-impact chamber. It has been found that the supersonic flow of steam causes the creation of filament loops when the steam impacts the yarn traveling through the intermixing device. These loops create a "wool like" appearance in the resulting product.

The process of the present invention may additionally comprise the step of extruding the primary yarns immediately prior to forwarding the primary yarns to the second godet (5). This creates the advantageous economic effect of elimination of the winding step used to make the packages (2, 22 and 26) shown in FIG. 2. In addition, although the accent yarn is generally thought to provide a desired coloration effect, one could utilize an antistatic yarn in order to impact an antistatic characteristic to the resulting product. The antistatic yarn (or the accent yarn, for that matter) could be a multifilament or a monofilament, and could be predrawn and pretextured or merely predrawn and untextured.

EXAMPLE 1

The process was carried out as shown in FIG. 2. A 6700 denier, 58 filament, undrawn nylon-6 white feed yarn (1) was fed from a package (2) through two guides (3 and 19), following which the feed yarn (1) came into contact with a pretensioning godet (4). As used herein, the term "godet" is meant to include both the large driven roll along with the smaller "idler" roll. When the yarn is described as being "wrapped around the godet", it is, of course, meant that the yarn is wrapped around the driven roll and the idler roll as a pair, rather than being wrapped more than 1 full circumference around any single roll.

A 726 denier 14 filament, undrawn (approximately 460% elongation to break), nylon-6, black "tonal" yarn (21) was taken from a second package (22), this yarn also passing through two guides (23 and 24) before merging into the white yarn (1) on the pretensioning godet (4). After making three wraps on the pretensioning godet, the combined feed and tonal yarns (1 and 21) made seven wraps around a second godet (5). The second godet (5) was maintained at a temperature of approximately 50° C. The surface speed of the second godet (5) was 372 meters per minute. The yarns (1 and 21) then made seven wraps around a third godet (6) having a surface speed of 1200 meters per minute and a temperature of 160° C. Of course, the yarns (1 and 21) were drawn approximately 3.2× between the godet (5) and the third godet (6). Upon contacting the third godet (6), an antistatic yarn (40), supplied from a yarn package (41) was merged into contact with the now drawn yarns (1 and 21). The antistatic yarn (40), the feed yarn (1), and the tonal yarn (21) were then texturized in a texturizing tube (42) similar to those described in U.S. Pat. Nos. 3,908,248 and 3,714,686. The texturizing tube was supplied with hot air (450° C.) at a pressure of 85 psi (source of hot air not shown). After texturing, the combined feed yarn (1), tonal yarn (21), and antistatic yarn (40) were passed partially around a direction changing roll (8) and then around a tensioning device (9), and finally around a fourth godet (10). The surface speed of the fourth godet was 905 meters per minute. A 220 denier, 14 filament, nylon-6, red "accent" yarn (25), supplied from a package (26), was then merged into contact with the already combined and texturized yarns 1, 21 and 40. After making 5 wraps around the fourth godet (10), the now combined yarns (1, 21, 40 and 25) were passed through an intermixing jet (11). The intermixing jet had a 180 degree slit which was 0.044 inches wide, this slit being supplied with saturated steam (177° C.) at 120 psig. The intermixing jet had a yarn-impact chamber which had a length of 0.3 inches and a diameter of 0.125 inches, and the intermixing jet was proportioned as shown in FIG. 3A. The impact of the steam on the traveling yarns created a high degree of filament entanglement between the feed yarn (1) and the tonal yarn (21) and also created filament loops which protruded from the highly entangled filaments at random intervals. The accent yarn was tied into the remaining filaments, but was not intimately mixed thereinto. The now intermixed yarns (43) then made 5 wraps around a fifth godet (12). The surface speed of the fifth godet (12) was 860 meters per minute The intermixed yarns (43) then passed around a direction changing roll (13) and were then wound to form a package (18) on a Rieter winder, Model JT/A, (14), at a speed of 864 meters per minute. The fourth and fifth godet pairs (10 and 12) were not heated, i.e. they were kept at room temperature. The yarn tension at specific points (A–G, as shown in FIG. 1) in the process was as follows:

| Designated Point in Process | Tension (Total, in Grams) |
|---|---|
| (a) | 6000 |
| (b) | 80 |
| (c) | 10 |
| (d) | 40 |
| (e) | 10 |
| (f) | 100 |
| (g) | 140 |

The resulting product was a yarn having textured, very evenly mixed white and black filaments together with a bundle of untextured, unmixed red filaments. When made into a carpet, the yarn appeared, from a distance, to be heather grey with flecks (i.e. points) of red randomly dispersed to give a berber effect. The white feed-yarn (1) could then be dyed in any of a wide variety of colors, as desired.

EXAMPLE 2

The process was carried out as shown in FIG. 1. An 1800 denier, 99 filament, undrawn, nylon-6 white feed-yarn (1) was fed from a package (2) through a guide (3) and onto a pretensioning godet (4), where the yarn was wrapped around the godet three times. The undrawn yarn had a elongation to break of approximately 460%. The yarn (1) was then wrapped seven times around a second godet (5), this second godet (5) being maintained at a temperature of 50° C. The second godet pair had a surface speed of 372 meters per minute. The yarn was then drawn between the second godet (5) and a third godet (6), which the yarn was wrapped around a total of seven times. The third godet (6) had a surface speed of 1200 meters per minute and was maintained at a temperature of 160° C. Upon exiting the third godet (6), the now drawn yarn (1) entered a texturing tube as described in Example 1. The texturizing tube was supplied with hot air (450° C.) at a pressure of 85 psi. After texturizing, the now drawn and texturized feed yarn (1) was passed partially around a direction changing roll (8) and then around a tensioning device (9), and finally around a fourth godet (10). The fourth godet (10) was not heated (i.e. was at room temperature) and was maintained at a surface speed of 880 meters per minute. After making 5 wraps around the fourth godet (10), the yarn (1) next passed through an intermixing jet (11). The intermixing jet had a 180 degree slit which was 0.044 inches wide, this slit being supplied with saturated steam (177° C.) at 120 psig. The intermixing jet (11) had a yarn-impact chamber which had a length of 0.3 inches and a diameter of 0.125 inches, and the intermixing jet was proportioned as shown in FIG. 3A. The impact of the steam on the traveling multifilament yarn created a high degree of filament entanglement and also created filament loops which protruded from the highly entangled filaments at random intervals. The yarn (1) then made 5 wraps around a fifth godet (12). The surface speed of the fifth godet (12) was 860 meters per minute. The yarn (1) then passed around a direction changing roll (13) and was then wound to form a package (18) on a Rieter Winder, Model JT/A, (14), at a speed of 875 meters per minute. The fourth and fifth godet pairs (10 and 12) were not heated, but instead were kept at room temperature. The yarn tension at specific points (A–G, as shown in FIG. 3) in the process was as follows:

| Designated Point in Process | Tension (Total, in Grams) |
|---|---|
| (a) | 3000 |
| (b) | 80 |
| (c) | 10 |
| (d) | 40 |
| (e) | 10 |
| (f) | 100 |
| (g) | 140 |

EXAMPLE 3

The process was carried out according to the schematic illustrated in FIG. 3. Eight 1089 denier, 14 filament undrawn precolored nylon-6 feed yarns (1) were feed from eight packages (2). Only four of the eight packages are shown in FIG. 3. Four of the eight yarns were brown, two yarns were beige, one yarn was orange, and one yarn was white. Each of the yarns (1) was first threaded through an individual guide (3), following which all eight yarns (1) were together threaded through a group guide (19). The feed yarns (1) were then directed through a preinterlacer (20). The preinterlacer (20) was supplied with compressed air at approximately room temperature and at a pressure of 150 psig. The preinterlacer (20) had a circular yarn throughout passageway 0.1875 inches in diameter and 0.30 inches long. The preinterlacer had three jet orifices, each of which intersected the axis of the yarn throughput orifice at an angle of 90 degrees. The axes of the three jet orifices were in a single plane and were positioned equidistantly from one another so that there was no net directional effect on the yarns being preinterlaced. Each jet orifice had a diameter of 0.0625 inches. After passing through the preinterlacer (20), the feed yarns (1) came into contact with a first (pretensioning) godet (4). After making three wraps around the first godet (4), the combined feed yarns (1) made seven wraps around a second godet (5). The second godet had a surface speed of 372 meters per minute and was heated to a temperature of 50° C. From here, the yarns (1) made ten wraps around a third godet (6), the third godet (6) having a surface speed of 1200 meters per minute and a temperature of 160° C. The yarns (1) were drawn 3.23× between the second godet (5) and the third godet (6). The yarns (1) were texturized in a texturing tube (7) similar to those described in U.S. Pat. No. 3,908,248 and 3,714,686. The texturizing tube was supplied with hot air (450° C.) at a pressure of 85 psi. After texturizing, the feed yarns (1) were passed partially around a direction changing roll (8) and then around a tensioning device (9), and finally made 5 wraps around a fourth godet (10). An antistatic yarn (25), supplied from a package (26), was merged with the feed yarns (1) on the fourth godet (10). The fourth godet was unheated, and had a surface speed of 905 meters per minute. The combined yarns (1, and 25) then passed through an intermixing device (11) and then made 5 wraps around a fifth godet (12) which had a surface speed of 860 meters per minute and was also unheated. From here the combined yarns (1, and 25) passed over a direction changing roll (13) and finally were taken up on a Rieter Winder, Model JT/A, (14), at a speed of 868 meters per minute. A yarn package (18) was formed by the winder (14). The yarn tension at specific points (A–G, as shown in FIG. 3) in the process was as follows:

| Designated Point in Process | Tension (Total, in Grams) |
|---|---|
| A | 5000 |
| B | 80 |
| C | 10 |
| D | 40 |
| E | 10 |
| F | 100 |
| G | 140 |

In the process described above, the intermixing jet was substantially as shown in FIGS. 3A, 3B, and 3C. The jet (11) had an 180 degree slit which was 0.044 inches wide, this slit being supplied with saturated steam (at 177° C.) at 120 psig. The jet (11) had a yarn-impact chamber which had a length of 0.3 inches and a diameter of 0.125 inches, and the intermixing jet was proportioned as shown in FIG. 3A. The product exhibited a very high degree of entanglement of the filaments, and filament loops also protruded from the resulting product

EXAMPLE 4

Figure 5:
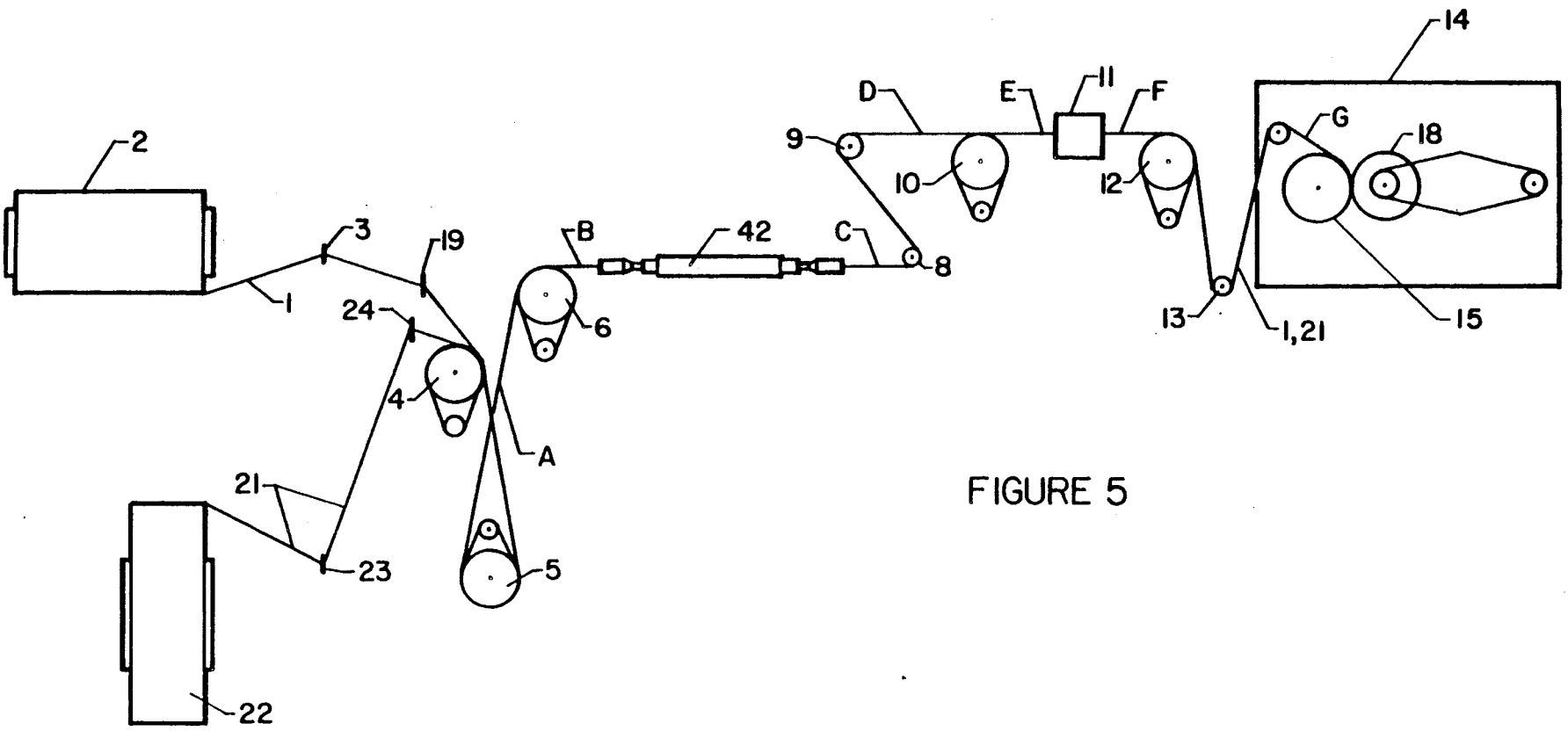
FIG. 5 is another alternative process of the present invention

This example is intended to show how the Standard Yarn Streak Potential Test may be applied to a process in order to determine the standard deviation which the process is capable of producing. A process (carried out as shown in FIG. 5) was subjected to the Standard Yarn Streak Potential Test in order to determine whether the resulting standard deviation was less than 6.0.

Two primary feed yarns (1 and 21) were drawn, textured, intermixed, and wound onto a package. The first feed yarn (1) was a 9100 denier (before drawing), 135 filament semidull (0.3 percent $TiO_2$), continuous filament, white polycaprolactam yarn. The second feed yarn (21) was a 2625 denier (before drawing), 42 filament, black continuous filament polycaprolactam feed yarn. These yarns were drawn, textured, intermixed, and taken up under the conditions described in Example 2. Thus, Example 4 is, in effect, a description for subjecting the process of Example 2 to the Standard Yarn Streak Potential Test. The resulting product was used to make a 0.1 gauge, level loop, 28 ounce per square yard carpet having a pile height of 3/16 inches. The carpet was tested by making colorimetric measurements with the Small Angle View attachment on a Macbeth 1500 colorimeter. Measurements take by the colorimeter represented the percent of light reflected upon subjecting a portion of the carpet to a given amount of light. Measurements were taken at 50 different locations on the carpet. The Macbeth 1500 colorimeter measured an area of approximately 2 centimeters by 1 centimeter, this area being oriented in the direction of tufting (i.e. along the length of the yarn). The values obtained were averaged in order to establish a standard reference point. After calculation of the standard reference point, another 75 measurements were made, each being compared with the standard reference point. The DL's were recorded (the DL's were based on the CIELAB color order system), and a standard deviation of 5.34 was calculated.

EXAMPLE 5

This example is intended to show how the Standard Yarn Streak Potential Test may be applied to a process similar to that discussed in Example 4. The process was carried out as shown in FIG. 5 and as described above in the process description related to FIG. 5. However, in place of the intermixing device (11), a conventional interlacer was utilized. The interlacer used was exactly the same as the preinterlacer (20) utilized in FIG. 3. However, in this Example, the interlacer (2)) of FIG. 3 was used in place of the intermixing device (11) of FIG. 5. The interlacer (20) was made and operated at the same specifications described in Example 3. Again, two primary feed yarns were drawn and textured exactly as in Example 4. The feed yarns were identical to those used in Example 4. The interlacer was supplied with compressed air at 150 psig. The resulting product was used to make a carpet of the same specifications as described in Example 4. Colorimetric measurements were taken exactly as described in Example 4. A standard deviation of 9.27 resulted.

A comparison of Examples 4 and 5 illustrates the need for the use of a device which is capable of intermixing the filaments rather than interlacing the filaments. A visual examination of the carpet produced in Example 4 revealed that the carpet produced via Example 4 exhibited a "solid heather" appearance. In contrast, a visual examination of the carpet produced via Example 5 revealed that the carpet produced via Example 5 exhibited a "random stria" appearance. It has been conceived that any carpet exhibiting a standard deviation of less than 6.0 (as measured by the test) will also exhibit a "solid heather" appearance, while any carpet exhibiting a standard deviation of greater than 9.0 (again, as measured by the test) will also exhibit a "random stria" appearance. The low streaking present in the solid heather carpets is considered to be highly desirable, and has been achieved in the past using both relatively low speed processes and plying processes.

Figure 6A:
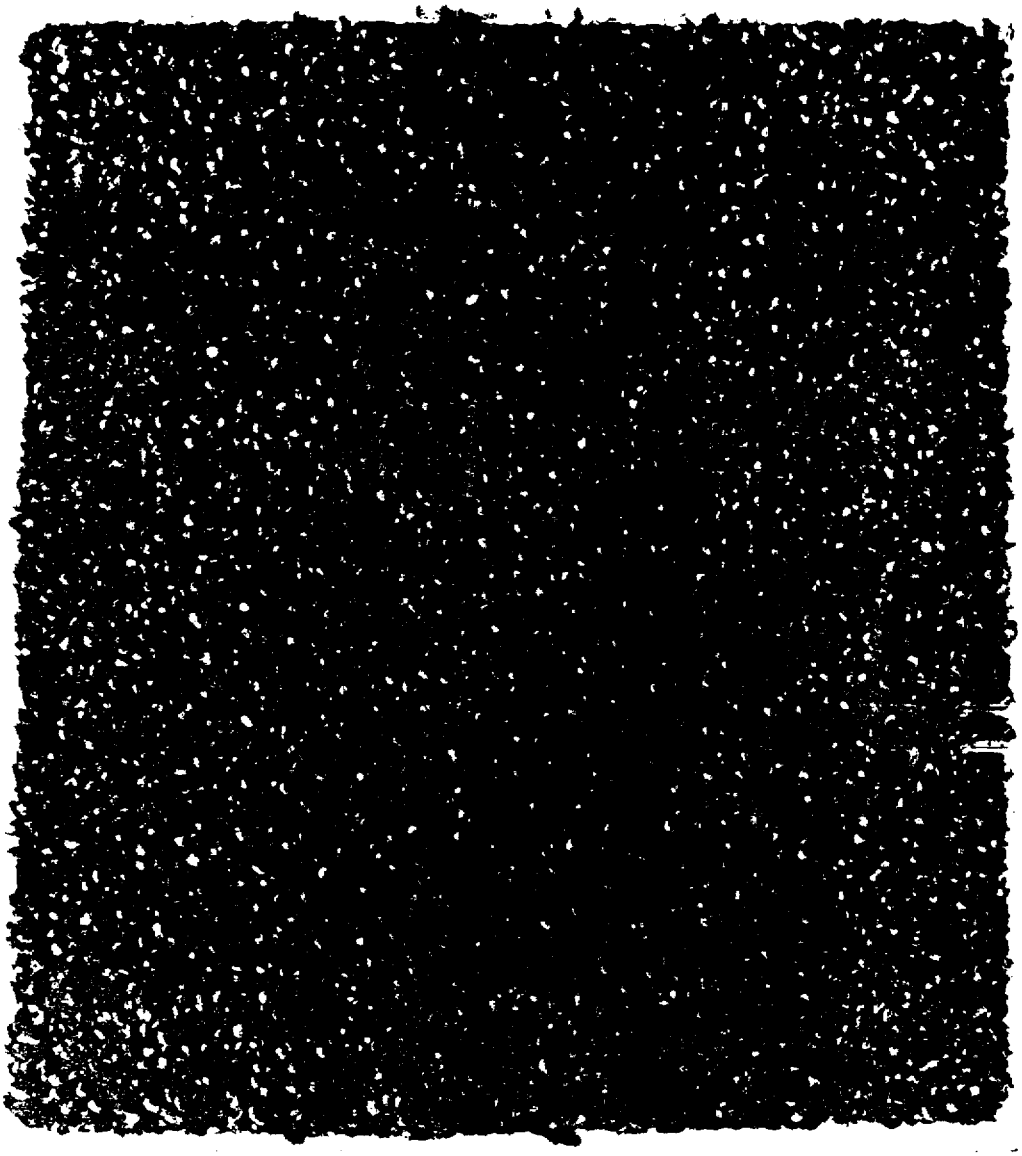
Figure 6B:
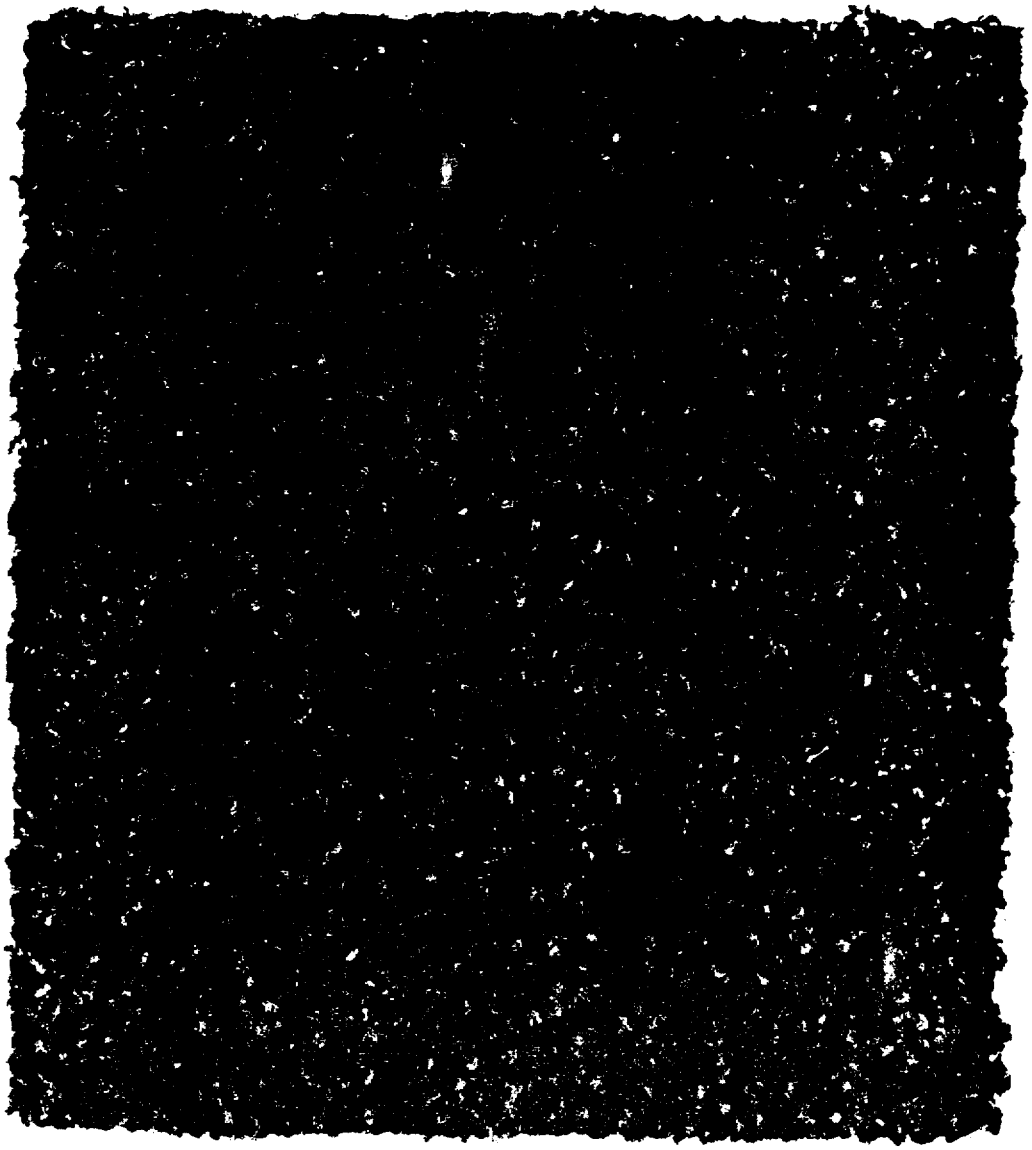
FIG. 6B illustrates the carpet of FIG. 6A after trafficking.
Figure 7A:
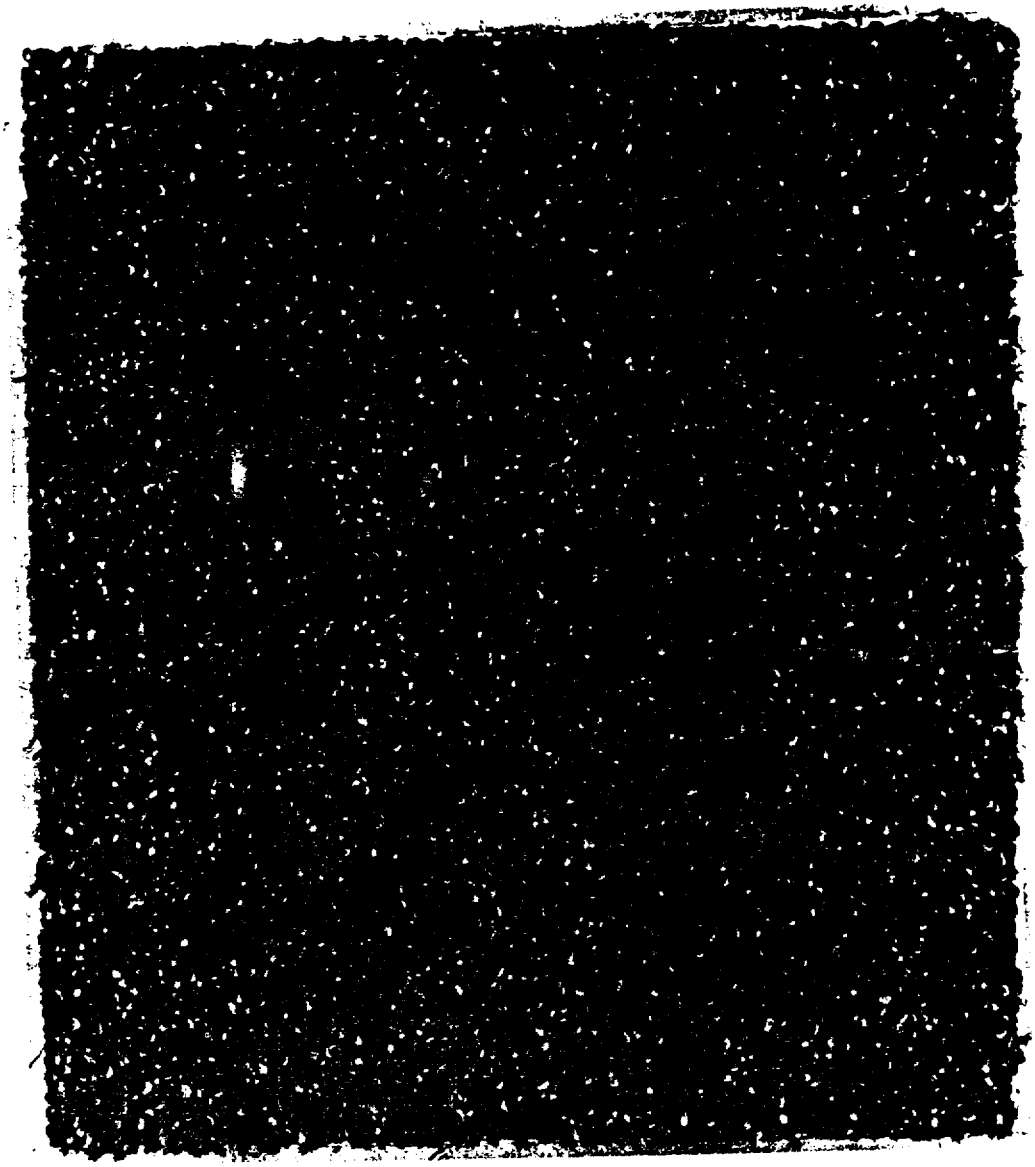
Figure 7B:
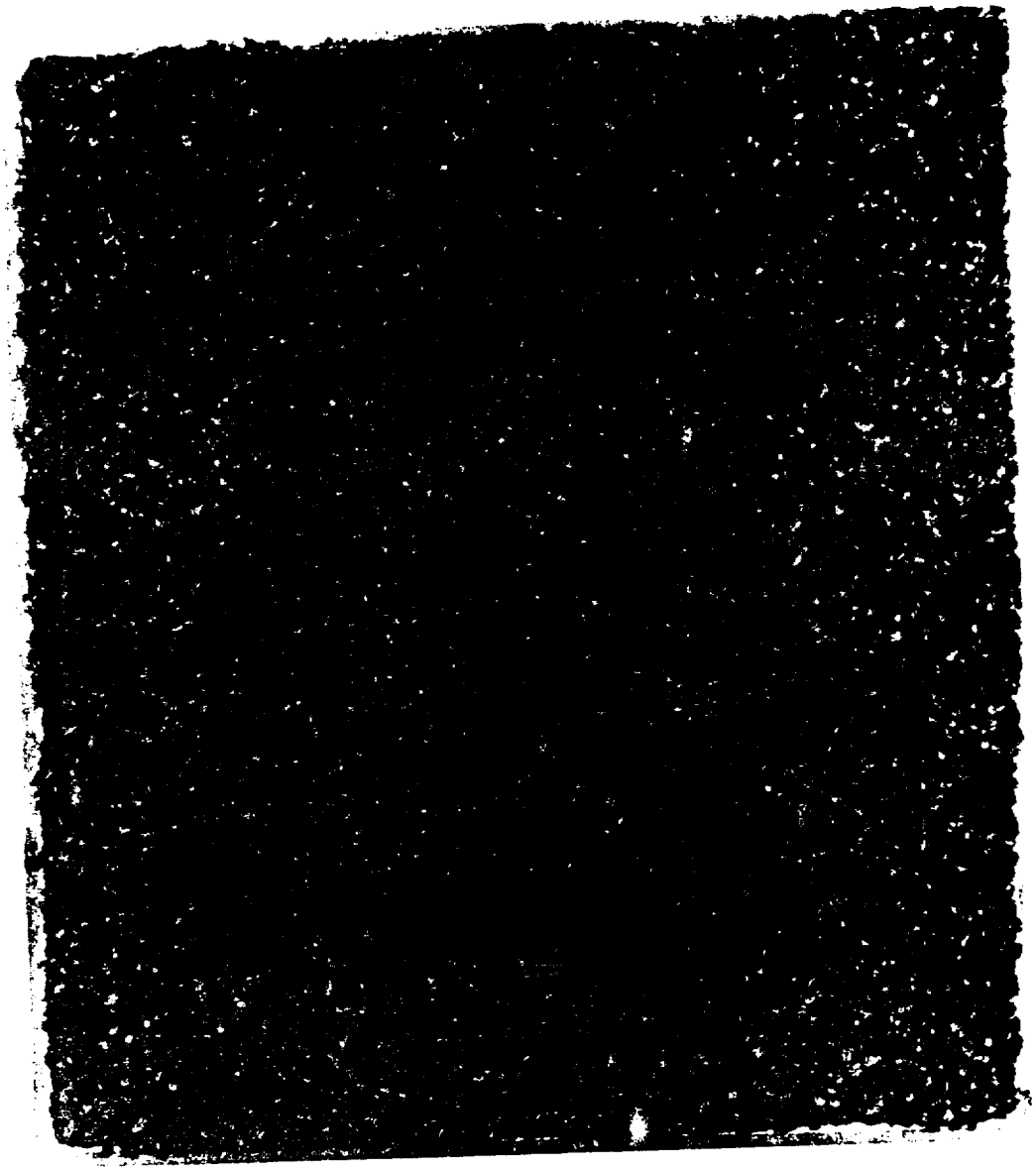
FIG. 7B illustrates the carpet of FIG. 7A after trafficking.

FIGS. 6A and 6B illustrate the effect of traffic on a carpet made using prior art technology. The carpet is new in FIG. 6A, while FIG. 6B illustrates the same carpet after 133,000 "traffics". FIG. 7A and 7B illustrate a carpet which is identical to the carpet of FIGS. 6A and 6B, except that the carpet shown in FIGS. 7A and 7B utilized an intermixing step in the yarn production process. FIG. 7A represents this carpet when new and FIG. 7B represents this carpet after 133,000 "traffics". A comparison of FIG. 6B with FIG. 7B illustrates the dramatic difference in tip definition after heavy trafficking. Obviously, the carpet made with the intermixed yarn (FIG. 7B) was far more durable in terms of tip definition (i.e. "ugly-out") than the carpet illustrated in FIG. 6B, which was made using a prior art interlaced yarn which had 10–12 nodes per meter.

Figure 8:
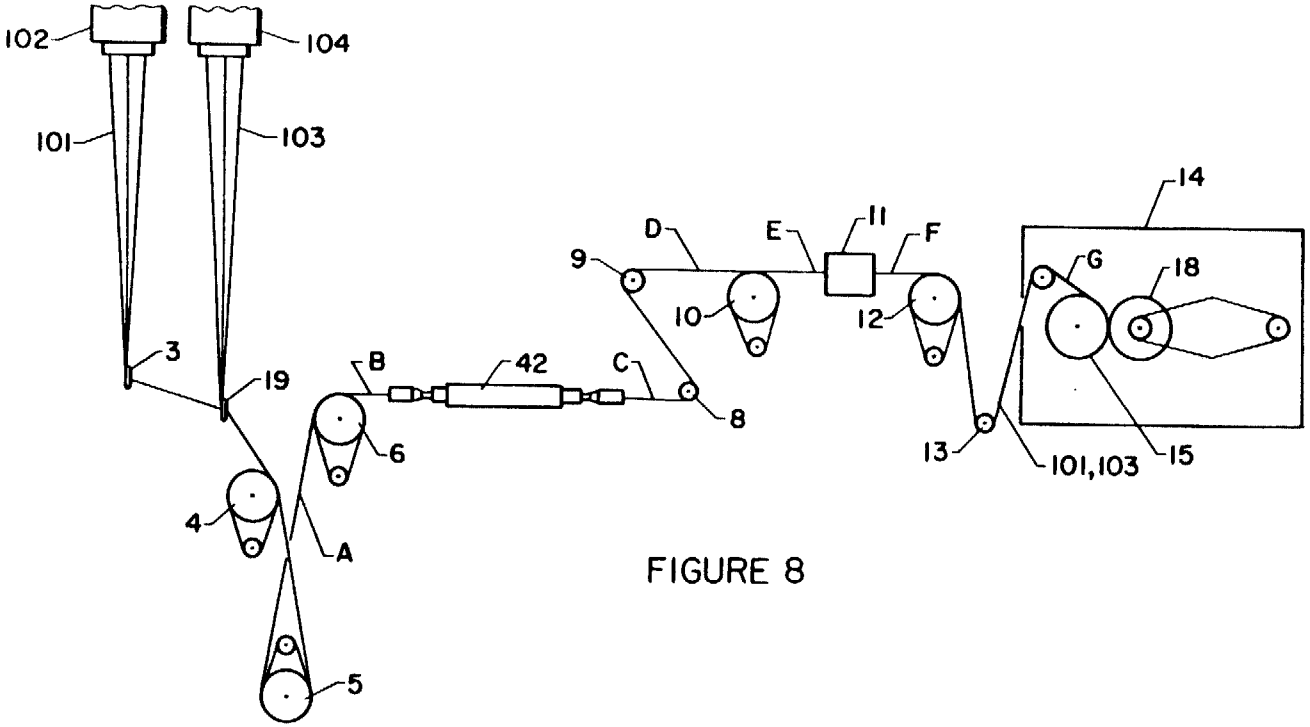
FIG. 8 depicts a carpet yarn process in which two primary yarns are co-spun.

FIG. 8 depicts a process in the manner of FIG. 5, except the carpet yarns are co-spun in a single process. Primary feed yarn 101 is spun from a conventional spinning device 102. A second feed yarn 103 of different characteristics is spun from spinning device 104. The two yarns are converged through eyelet guides 3 and 19 prior to being contacted by pretensioning godet 4. The combined yarns are then drawn between godets 5 and 6, textured in device 42, intermixed in jet 11 and wound into a package 15.

The carpets shown in FIGS. 6A and 6B are velvet plush (cut loop) carpets having a pile height of ⅜ inches, and 48 oz./square yard of face yarn. The yarns used in both carpets consisted of: (a) an 1800 denier nylon-6 bulked continuous filament space dyed yarn, which was plied with (b) two ends of 2000 denier, stock dyed, nylon-6 spun yarn. The spun yarns were each made from 8 inch burgundy colored staple. Each of the spun yarns had 3½ twists per inch, and the plying process inserted 1½ twists per inch into the final yarn. The space dyed yarn was dyed black and brown. In the carpet shown in FIG. 5A, the 1800 denier space dyed yarn was interlaced so that it contained 10–12 nodes per meter, while in the carpet shown in FIG. 7A, the 1800 denier space dyed yarn was intermixed so that it had virtually continuous filament entanglement.

FIGS. 5A, 5B, 7A and 7B illustrate the fact that the process of the present invention is capable of making a yarn at high speed which has improved tip definition over prior art carpets which are made at high speed with entanglement via interlacing. Improved tip definition is an improvement for any carpet, i.e. both solid an multicolored carpets. The reason for using multicolored yarns in FIGS. 5A and 7A was simply for purposes of making the improved tip definition more conspicuous.

We claim:

1. A continuous high speed process for the manufacture of a "berber" effect carpet yarn comprising the steps of:

overfeeding at least one primary bundle of drawn, crimped carpet filaments of 18 to 35 denier per filament with an accent bundle of drawn, uncrimped carpet filaments, the total denier of the primary bundle and accent bundle being 2,000–4,000, through the mixing chamber of an intermixing jet, the chamber having a length to diameter ratio of about 2.4 and further having a slit of about 180° around the chamber for admitting steam under supersonic flow conditions; providing said steam to said chamber to continually intermix the crimped filaments along the entire length thereof, the accent yarn remaining substantially intact and thereafter winding the yarn at a speed of at least 800 meters per minute.

2. The continuous process of claim 1 wherein at least one primary bundle of drawn, crimped carpet filaments contains a texturized antistatic yarn.

* * * * *

UNITED STATES PATENT AND TRADEMARK OFFICE

CERTIFICATE OF CORRECTION

PATENT NO. : 4,993,130

DATED : February 19, 1991

INVENTOR(S) : Andrew M. Coons, III, et al.

It is certified that error appears in the above-identified patent and that said Letters Patent is hereby corrected as shown below:

Title page: The sheets of drawings consisting of Figs. 6A,6B, 7A, 7B and figure 8, should be added as shown on the attached page.

Item (22) should read -- May 1, 1989--.

Signed and Sealed this

Twenty-ninth Day of September, 1992

*Attest:*

DOUGLAS B. COMER

*Attesting Officer*

*Acting Commissioner of Patents and Trademarks*